US006964272B2

(12) United States Patent
Scherer

(10) Patent No.: US 6,964,272 B2
(45) Date of Patent: Nov. 15, 2005

(54) BLOCK SPLITTING ASSEMBLY AND METHOD

(75) Inventor: Ronald J. Scherer, Shakopee, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 10/817,736

(22) Filed: Apr. 2, 2004

(65) Prior Publication Data

US 2004/0221545 A1 Nov. 11, 2004

Related U.S. Application Data

(63) Continuation-in-part of application No. 10/103,155, filed on Mar. 20, 2002, now Pat. No. 6,874,494.

(51) Int. Cl.[7] ..... B28D 1/26
(52) U.S. Cl. ..... 125/23.01; 125/40
(58) Field of Search ..... 125/23.01, 40

(56) References Cited

U.S. PATENT DOCUMENTS

| | | | | |
|---|---|---|---|---|
| 470,788 | A | 3/1892 | Devine | |
| 806,951 | A | 12/1905 | Bryning | |
| 1,534,353 | A | 4/1925 | Besser | |
| 1,893,430 | A | 1/1933 | McKenzie | |
| 2,303,935 | A | * 12/1942 | Hedlund | 62/320 |
| 2,593,606 | A | 4/1952 | Price | |
| 2,746,447 | A | 5/1956 | Petch | |
| 2,775,236 | A | 12/1956 | Blum | |
| 2,867,205 | A | 1/1959 | Vesper | |
| 2,881,753 | A | 4/1959 | Entz | |
| 2,925,080 | A | 2/1960 | Smith | |
| 3,095,868 | A | 7/1963 | Mangis | |
| 3,120,842 | A | 2/1964 | Cox et al. | |
| 3,392,719 | A | 7/1968 | Clanton et al. | |
| 3,559,631 | A | 2/1971 | Mangis | |
| 3,809,049 | A | 5/1974 | Fletcher et al. | |
| 4,250,863 | A | 2/1981 | Gagnon et al. | |
| 4,335,549 | A | 6/1982 | Dean, Jr. | |
| 5,066,070 | A | 11/1991 | Clarke | |
| 5,152,275 | A | 10/1992 | Landhuis | |
| 5,413,086 | A | 5/1995 | Trudeau | |
| 5,662,094 | A | 9/1997 | Giacomelli | |
| 5,687,515 | A | 11/1997 | Rodrigues et al. | |
| 5,722,386 | A | 3/1998 | Fladgard et al. | |
| 5,762,061 | A | 6/1998 | Bevan | |
| 6,050,255 | A | 4/2000 | Sievert | |
| 6,102,026 | A | 8/2000 | Fladgard et al. | |
| 6,321,740 | B1 | 11/2001 | Scherer et al. | |

(Continued)

FOREIGN PATENT DOCUMENTS

| | | |
|---|---|---|
| EP | 0 294 267 A1 | 12/1988 |
| GB | 1 245 921 | 9/1971 |
| GB | 1 509 747 | 5/1978 |
| WO | WO 03/080305 A1 | 10/2003 |

OTHER PUBLICATIONS

Copy of U.S. Appl. No. 09/691,864, entitled "Block Splitting Assembly and Method," filed Oct. 19, 2000.
Copy of U.S. Appl. No. 09/884,795, entitled "Block Splitting Assembly and Method," filed Jun. 19, 2001.
Copy of U.S. Appl. No. 10/411,453, entitled "Block Splitting Assembly and Method," filed Apr. 10, 2003.
"Fairlane Positioning and Workholding Products," http: www.fairlaneprod.com.index.htm. Fairlane Products Inc., 2 pages (Date Printed Nov. 15, 2001).

*Primary Examiner*—M. Rachuba
(74) *Attorney, Agent, or Firm*—Merchant & Gould P.C.

(57) ABSTRACT

The invention relates to equipment and related methods for producing concrete blocks. The equipment and methods described herein utilize splitting assemblies having larger projections and/or smaller projections or peaks disposed on at least one side of a splitting line and which engage the workpiece as it is split into at least two pieces.

31 Claims, 9 Drawing Sheets

U.S. PATENT DOCUMENTS

| | | | |
|---|---|---|---|
| 6,401,707 | B1 | 6/2002 | Fladgard et al. |
| D464,145 | S | 10/2002 | Scherer et al. |
| 6,460,534 | B1 | 10/2002 | Vasquez et al. |
| 2002/0015620 | A1 | 2/2002 | Woolford et al. |
| 2002/0092257 | A1 | 7/2002 | Scherer et al. |
| 2003/0180099 | A1 | 9/2003 | Scherer et al. |

* cited by examiner

BLOCK SPLITTING ASSEMBLY AND METHOD

This application is a continuation-in-part of application Ser. No. 10/103,155, filed on Mar. 20, 2002 now U.S. Pat. No. 6,874,494.

FIELD OF THE INVENTION

The invention relates generally to the manufacture of concrete blocks. More specifically, it relates to equipment and processes for the creation of decorative faces on concrete blocks. Even more specifically, the invention relates to equipment and processes for producing irregular textures and the appearance of weathered or rock-like edges on concrete blocks, as well as to concrete blocks that result from such equipment and processes.

BACKGROUND OF THE INVENTION

It has become common to use concrete blocks for landscaping purposes. Such blocks are used to create, for example, retaining walls, ranging from small tree ring walls and garden edging walls to comparatively large structures. Concrete blocks are made in high speed production plants, and are often exceedingly uniform in appearance. This is not an undesirable characteristic in some landscaping applications, but it is a drawback in many applications where there is a demand for a "natural" appearance to the material used to construct retaining walls and other landscaping structures.

One way to make concrete blocks less uniform, and more "natural" appearing, is to use a splitting process to create a "rock-face" on the block. In this process, as it is commonly practiced, a large concrete workpiece which has been adequately cured is split to form two blocks. The resulting blocks have faces along the plane of splitting that are textured and irregular. This process of splitting a workpiece into two concrete blocks to create a rock-like appearance on the exposed faces of the blocks is shown, for example, in Besser's U.S. Pat. No. 1,534,353, which discloses the manual splitting of blocks using a hammer and chisel.

Automated equipment to split a concrete workpiece to form blocks is well-known, and generally includes splitting apparatus comprising a supporting table and opposed, hydraulically-actuated splitting blades. A splitting blade in this application is typically a substantial steel plate that is tapered to a relatively narrow or sharp knife edge. The blades typically are arranged so that the knife edges will engage the top and bottom surfaces of the workpiece perpendicular to those surfaces, and they are coplanar with each other. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits, generally along the plane of alignment of the blades.

These machines are useful for the high-speed processing of blocks. They produce an irregular, rock-face finish on the blocks. No two faces resulting from this process are identical, so the blocks are more natural in appearance than standard, non-split blocks. However, the edges of the faces resulting from the industry-standard splitting process are generally well-defined, i.e., regular and "sharp". These concrete blocks can be made to look more natural if the regular, sharp edges of their faces are eliminated.

One known process for eliminating the regular, sharp edges on concrete blocks is the process known as tumbling.

In this process, a relatively large number of blocks are loaded into a drum which is rotated around a generally horizontal axis. The blocks bang against each other, knocking off the sharp edges, and also chipping and scarring the edges and faces of the blocks. The process has been commonly used to produce a weathered, "used" look to concrete paving stones. These paving stones are typically relatively small blocks of concrete. A common size is 3.75 inches wide by 7.75 inches long by 2.5 inches thick, with a weight of about 6 pounds. The tumbling process is also now being used with some retaining wall blocks to produce a weathered, less uniform look to the faces of the blocks.

There are several drawbacks to the use of the tumbling process in general, and to the tumbling of retaining wall blocks, in particular. In general, tumbling is a costly process. The blocks must be very strong before they can be tumbled. Typically, the blocks must sit for several weeks after they have been formed to gain adequate strength needed for the tumbling process. This means they must be assembled into cubes, typically on wooden pallets, and transported away from the production line for the necessary storage time. They must then be transported to the tumbler, depalletized, processed through the tumbler, and recubed and repalletized. All of this "off-line" processing is expensive. Additionally, there can be substantial spoilage of blocks that break apart in the tumbler. The tumbling apparatus itself can be quite expensive, and a high maintenance item.

Retaining wall blocks, unlike pavers, can have relatively complex shapes. They are stacked into courses in use, with each course setback a uniform distance from the course below. Retaining walls must also typically have some shear strength between courses, to resist the pressure of the soil behind the wall. A common way to provide uniform setback and course-to-course shear strength is to form an integral locator and shear protrusion on the blocks. Commonly these protrusions take the form of lips (or flanges) or tongue and groove structures. Because retaining wall blocks range in size from quite small blocks having a front face with an area of about 0.25 square feet and weighing about 10 pounds, up to quite large blocks having a front face of a full square foot and weighing on the order of one hundred pounds, they may also be cored, or have extended tail sections. These complex shapes cannot survive the tumbling process. Integral protrusions get knocked off, and face shells get cracked through. As a consequence, the retaining wall blocks that do get tumbled are typically of very simple shapes, are relatively small, and do not have integral protrusions. Instead, they must be used with ancillary pins, clips, or other devices to establish setback and shear resistance. Use of these ancillary pins or clips makes it more difficult and expensive to construct walls than is the case with blocks having integral protrusions.

Another option for eliminating the sharp, regular edges and for creating an irregular face on a concrete block is to use a hammermill-type machine. In this type of machine, rotating hammers or other tools attack the face of the block to chip away pieces of it. These types of machines are typically expensive, and require space on the production line that is often not available in block plants, especially older plants. This option can also slow down production if it is done "in line", because the process can only move as fast as the hammermill can operate on each block, and the blocks typically need to be manipulated, e.g. flipped over and/or rotated, to attack all of their edges. If the hammermill-type process is done off-line, it creates many of the inefficiencies described above with respect to tumbling.

Yet another option for creating a more natural block face appearance and eliminating the sharp, regular edges of concrete blocks is disclosed in commonly assigned, copending U.S. patent application Ser. No. 09/884,795 (filed Jun. 19, 2001), and Ser. No. 09/691,864 (filed Oct. 19, 2000), and in U.S. Pat. No. 6,321,740, which are incorporated herein by reference in their entirety. As disclosed in these copending applications and patent, a splitting assembly is provided with a plurality of projections that are positioned to engage the workpiece during splitting to create an irregular upper and/or lower front edge on the resulting block. As is further described in commonly assigned, copending U.S. patent application Ser. No. 10/103,155 (filed Mar. 20, 2002) and Ser. No. 10/411,453 (filed Apr. 10, 2003), smaller projections in the form of a multiplicity of peaks can used in place of, or to supplement the action of, the larger projections to eliminate the sharp, regular edges of concrete blocks.

SUMMARY OF THE INVENTION

The invention relates to equipment and related methods for producing concrete retaining wall blocks.

In accordance with a first aspect of the invention, a splitting assembly for a block splitting machine comprises a block splitter defining a splitting line, the block splitter being configured and positioned to engage a surface of a concrete workpiece and split the workpiece along the splitting line during a splitting operation to form at least one concrete block with an irregular front face. In addition, the splitting assembly includes a multiplicity of peaks that are positioned to engage a surface of the workpiece during the splitting operation and chip and roughen at least one edge of the at least one block generally along the front face of the block adjacent the splitting line. The multiplicity of peaks include peaks extending over a distance parallel to the splitting line and peaks extending over a distance away from the splitting line. Further, the multiplicity of peaks have tips that lie generally on a plane that is at an angle that is greater than or equal to about 5 degrees and less than or equal to about 20 degrees relative to horizontal, the plane containing the tips of the peaks being further from the workpiece the further the plane is from the block splitter, and the peaks have a height that is greater than or equal to about 0.125 inch and less than or equal to about 0.375 inch.

In accordance with a second aspect of the invention, a splitting assembly for a block splitting machine comprises a block splitter defining a splitting line, the block splitter being configured and positioned to engage a surface of a concrete workpiece and split the workpiece along the splitting line during a splitting operation to form at least one concrete block with an irregular front face. The splitting assembly also includes a plurality of projections positioned to engage a surface of the workpiece at the comers of the at least one block during the splitting operation and break away portions of the workpiece at the comers of the block adjacent the splitting line. In addition, the splitting assembly includes a multiplicity of peaks between the projections and positioned to engage a surface of the workpiece during the splitting operation and chip and roughen at least one edge of the at least one block along the front face of the block adjacent the splitting line. The multiplicity of peaks include peaks extending over a distance parallel to the splitting line and peaks extending over a distance away from the splitting line. Further, the multiplicity of peaks have tips that lie generally on a plane that is at an angle that is greater than or equal to about 5 degrees and less than or equal to about 20 degrees relative to horizontal, the plane containing the tips of the peaks being further from the workpiece the further the plane is from the block splitter, and the peaks have a height that is greater than or equal to about 0.125 inch and less than or equal to about 0.375 inch.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

The invention relates to the splitting of concrete workpieces to create a more natural appearance to the faces and edges of concrete blocks that result from splitting the workpieces. The concrete blocks can be, for example, concrete retaining wall blocks that are intended to be dry-stacked with other like blocks into courses, architectural or masonry blocks for use in building construction where the blocks are laid up with other like blocks in courses with mortar between the blocks to secure the blocks together, and other concrete blocks.

Equipment and processes that create a more natural appearing block face and which eliminate the regular, sharp face edges are disclosed in commonly assigned, copending U.S. patent application Ser. Nos. 09/884,795, 09/691,864, 10/103,155, and 10/411,453, and in U.S. Pat. No. 6,321,740, which are incorporated herein by reference in their entirety. As disclosed in these documents, top and bottom splitting assemblies are positioned opposite each other on opposite sides of a concrete workpiece that is to be split by the splitting assemblies. A typical workpiece that is split is formed by two blocks molded from dry cast, no-slump concrete in a face-to-face arrangement so that splitting of the workpiece creates irregular front faces on both blocks.

Figure 1:
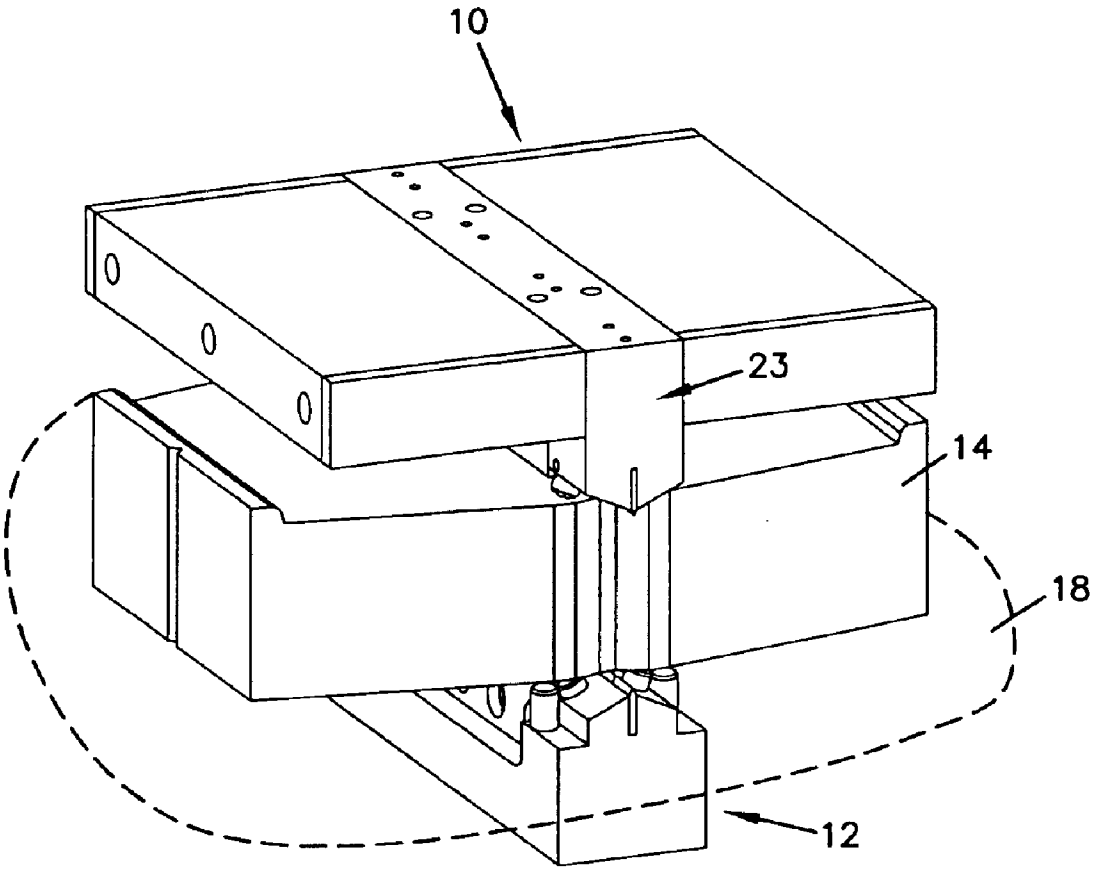
FIG. 1 is a partial perspective view of a splitting area of a block splitting machine using block splitting assemblies of the invention.

Attention is now directed to the figures where like parts are identified with like numerals. FIG. 1 illustrates top and bottom splitting assemblies 10, 12 in accordance with the present invention positioned relative to an adequately cured workpiece 14 that is to be split into two pieces. It is preferred that the split pieces each be a concrete block, and the invention will be hereinafter described with respect to the production of two concrete blocks, particularly retaining wall blocks. However, one split piece could be a concrete block while the other split piece is a waste piece.

The splitting assemblies 10, 12 are utilized in a block splitting machine having a splitting line SL with which a cleaving line of the workpiece to be split is aligned in a ready-to-split position. The splitting line SL is illustrated in dashed lines in FIGS. 3 and 5. The cleaving line of the workpiece 14 is not illustrated but is aligned with the splitting line during splitting. The splitting line SL is typically an imaginary line in the block splitting machine. However, the splitting line SL could be denoted by an actual line provided in the block splitting machine to provide a visual reference to users of the machine. In addition, the cleaving line of the workpiece is typically an imaginary line on the workpiece along which it is desired to split the workpiece. The cleaving line could also be defined by a pre-formed splitting groove(s) defined in the top or bottom surface, or both surfaces, of the workpiece 14.

Block splitting machines suitable for utilizing the top and bottom splitting assemblies 10, 12 so as to practice the present invention may be obtained from Besser Company located in Alpena, Michigan and other equipment manufacturers. When referring to the splitting assemblies 10, 12, the terms "bottom", "lower", "top", and "upper" refer to the position of the splitting assemblies relative to the workpiece 14 during splitting. Likewise, when referring to the workpiece 14, the terms "bottom", "lower", "top", and "upper" refer to the particular workpiece surfaces as they are oriented during splitting. The workpiece 14 is preferably oriented "lips up" during splitting. This "lips up" orientation allows the workpiece 14 to lay flat on what will be the upper surfaces of the resulting blocks when the blocks are laid in a wall.

Figure 2:
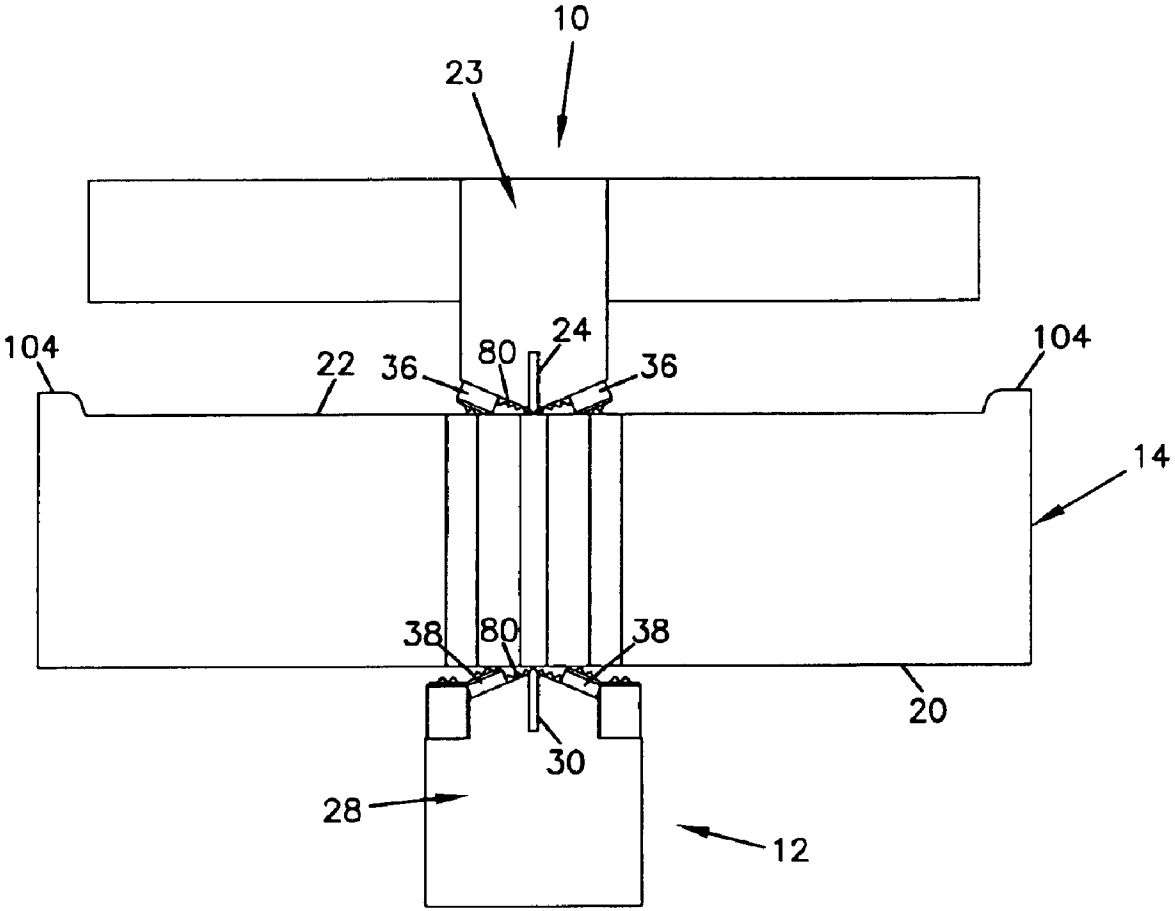
FIG. 2 is a side view of the splitting area of FIG. 1 illustrating the top and bottom splitting assemblies positioned relative to a workpiece.

With reference to FIGS. 1 and 2, the bottom splitting assembly 12 is adapted to move upwardly through an opening in a support table 18 (shown in dashed lines in FIG. 1) of the block splitting machine in a manner known in the art, to engage a bottom surface 20 of the workpiece 14 during the splitting operation, and to move downwardly through the opening back to a home position after completion of the splitting operation so that the blocks can be removed from the splitting machine and another workpiece can be positioned for splitting. The support table 18 supports the workpiece 14 during splitting.

As can be further seen in FIGS. 1 and 2, the top splitting assembly 10 is positioned above the workpiece 14, opposite the bottom splitting assembly 12, in order to engage a top surface 22 of the workpiece during a splitting operation. The top splitting assembly 10 is mounted so as to be moveable downward into engagement with the workpiece 14, and to be moveable upward to a home position so that a subsequent workpiece can be positioned for splitting. It is typical for the top splitting assembly 10 to be actuated so as to contact the workpiece 14 before the bottom splitting assembly 12 makes contact. The mechanisms for causing movement of the splitting assemblies 10, 12 are well known to persons having ordinary skill in the art.

With reference to FIGS. 1–4, the top splitting assembly 10 is seen to include a block splitter holder 23 having a block splitter 24 secured thereto, which together form means for splitting the workpiece. In the embodiment illustrated, the holder 23 comprises a blade holder, and the block splitter 24 comprises a splitting blade. For sake of convenience, the invention will hereinafter be described by referring to "blade holder 23" or "holder 23" and "splitting blade 24" or "blade 24". However, it is to be realized that the holder 23 and the splitter 24 (as well as the holder and splitter of the bottom splitting assembly 12) could be formed by structures other than those illustrated in the figures.

The blade 24 is positioned to engage the top surface 22 of the workpiece and split the workpiece along the splitting line. The blade 24 includes a central splitting edge 25. As is evident from FIG. 3, the central splitting edge 25 extends parallel to and defines the splitting line SL along which the workpiece(s) will be split. In the preferred embodiment, the splitting line SL is generally a straight line, and the resulting split face of each block will be generally straight from side face to side face as a result. However, the splitting line could take on other configurations, such as, for example, curved, if desired, in which case the splitting edge 25 would be curved so as to produce a split face that is curved from side face to side face.

Likewise, as seen in FIGS. 1, 2, 5 and 6, the bottom splitting assembly 12 includes a blade holder 28 having a blade 30 that includes a central splitting edge 32. The blade 30 is positioned to engage the bottom surface 20 of the workpiece and split the workpiece along the splitting line. The central splitting edge 32 preferably extends parallel to the splitting edge 25 along the splitting line SL.

The splitting assemblies 10, 12 include larger projections 36, 38 that are positioned on the splitting assemblies at locations corresponding to the comers of the blocks to break away portions of the workpiece at the comers of the block adjacent the splitting line. In addition, the splitting assemblies 10, 12 also include smaller projections in the form of a multiplicity of peaks 34*a*, 34*b* that are positioned between the larger projections 36, 38 and which break away less of the block material along the top and bottom edges between the projections to chip and roughen those edges, thereby resulting in a more natural appearing block.

The projections 36, 38 are provided on surfaces 27*a*, 27*b*, 35*a*, 35*b* of the blade holders 23, 28 disposed on each side of the peaks 34*a*, 34*b*. As illustrated, the surfaces 27*a*, 27*b*, 35*a*, 35*b* extend away from the blades 24, 30, respectively, at an angle β. The angle β is preferably between about 15 degrees and about 45 degrees, more preferably between about 20 degrees and about 25 degrees, and most preferably about 22 degrees.

The projections 36, 38 are preferably adjustable and removable. In this way, the same splitting assemblies can be used for splitting different workpiece configurations by changing the number, location, spacing and height of the projections. The projections are preferably threaded into corresponding threaded openings in the surfaces 27*a*, 27*b*, 35*a*, 35*b* for height adjustment, although other height adjustment means could be employed. However, during a splitting action, the projections 36, 38, the blades and the blade holders are in a fixed relationship relative to each other, whereby as the blade holder moves, the projections 36, 38 associated with the blade and blade holder move simultaneously therewith.

The projections 36, 38 in this embodiment are generally cylindrical and are preferably made of a carbide-tipped metal material. In addition, the top surfaces of the projections 36, 38 are jagged, comprising many pyramids in a checkerboard pattern. Projections such as these can be obtained from Fairlane Products Co. of Fraser, Mich. It will be understood that a variety of other projection top surface configurations could be employed. The height of the top surface of the projections is preferably equal to or no greater than about 0.125 inches below the splitting edges 25, 32 of the blades 24, 30. However, the projections may extend further below, or some distance above, the top of the blades 24, 30, within the principles of the invention.

The diameter of the projections are between about 0.625 inch to about 1.0 inch. In addition, the projections 36, 38 can be about 0.75 inches long from end to end. While the projections are adjustable, the loose block material from the splitting process entering the threads of the projections, in combination with the vertical force of the splitting strikes, are considered sufficient to lock the projections in place. However, other mechanisms could be used to lock the projections in place relative to the blades during the splitting process, such as set-screws.

The blades 24, 30 and the projections 36, 38 are wear locations during the splitting process. The removable mounting of the projections 36, 38 permits the projections to be removed and replaced as needed due to such wear. It is also preferred that the blades 24, 30 be removable and replaceable, so that as the blades wear, they can be replaced as needed. The blades 24, 30 can be secured to the respective blade holders 23, 28 through any number of conventional removable fastening techniques, such as by bolting the blades to the blade holders, with each blade being removably disposed within a slot formed in the respective blade holder as shown in FIGS. 1–6.

The bottom splitting assembly 12 also includes adjustable and removable projections 40 extending vertically upward from horizontal surfaces 40 formed on the blade holder 28, as shown in FIGS. 1–3, 5 and 6. The projections 40 are similar in construction to the projections 36, 38, although the projections 40 can be larger or smaller in size than the projections 36, 38, depending upon the desired effect to be achieved. The projections 40 can be about 1.5 inches in length.

The angling of the projections 36, 38 on the surfaces 27*a*, 27*b*, 35*a*, 35*b* of the blade holders 23, 28 allows the projections 36, 38 to gouge into the workpiece(s) and break away material primarily adjacent the comers of the resulting blocks. As noted above, the bottom splitting assembly 12 typically contacts the workpiece 14 after the top splitting assembly 10 has begun its splitting action. The initial splitting action of the top splitting assembly 10 can force the resulting split pieces of the workpiece 14 away from each other before the bottom splitting assembly 12 and the angled projections 38 can fully complete their splitting action. However, the vertical projections 40 on the surfaces 40 of the blade holder 28 help to hold the blocks in place to enable the angled projections 38 to complete their splitting action. The vertical projections 40 also break away portions of the blocks adjacent the comers of the resulting blocks.

In the illustrated embodiment, the projections 36, 38 are arranged so that the central axes thereof extend generally at right angles from the surfaces 27*a*, 27*b*, 35*a*, 35*b*. However, other orientations of the projections are possible. For example, the projections 36, 38 could be oriented so that the central axes thereof extend generally parallel to the projections 40. In addition, the projections 36, 38 could be oriented so that the central axes thereof angle toward the blades 24, 30.

As indicated above, the projections 36, 38, 40 of the splitting assemblies 10, 12 are located so that they engage portions of the resulting block(s) that correspond to the top and bottom, left and right front comers thereof. (When referring to the resulting blocks, the terms "top", "bottom", "upper", and "lower"refer to the blocks as they will be laid in a wall.) This is evident from FIGS. 1 and 3 which illustrate the projections 36 positioned adjacent each end of the holder 23, and from FIGS. 5 and 6 which illustrate the projections 38, 40 positioned adjacent each end of the holder 28.

With reference to FIGS. 2–6, the multiplicity of smaller projections or peaks 34*a*, 34*b* are positioned between the projections 36, 38, 40 to break away block material along the top and bottom edges of the blocks adjacent the front faces of the blocks, so as to chip and roughen the top and bottom edges of the blocks between the front comers. This helps make the blocks appear more natural, and minimizes the appearance of a ledge when the blocks are stacked into set-back courses.

Figure 7:
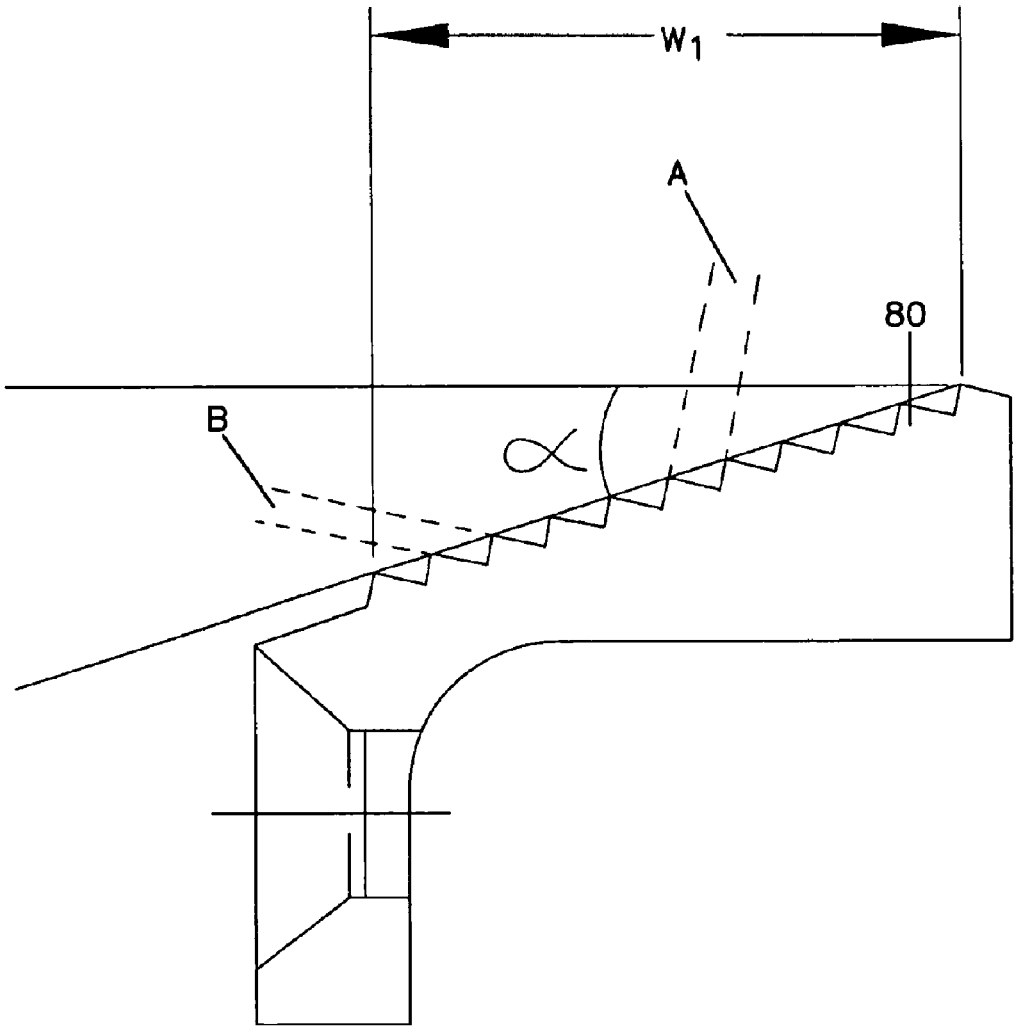
FIG. 7 is a detailed view of the multiplicity of peaks.

In the preferred embodiment, the multiplicity of peaks 34*a*, 34*b* extending along the splitting line are joined together to form a plurality of ridges 80 extending parallel to the splitting edges 25, 32 of the blades 24, 30, with valleys or grooves defined between adjacent ridges. The alternating ridges 80 and valleys form a generally serrated or saw-toothed appearance when viewed from the end, as shown in FIG. 7. The ridges 80 are preferably angled in a direction toward the workpiece 14, and preferably have sharp tips. The ridges 80 and valleys can be used alone, or in combination with the projections 36, 38, 40. As an alternative to the ridges 80, the peaks could comprise a plurality of pyramid-shaped projections arranged in a checkerboard pattern.

As illustrated, the ridges 80 extend from adjacent the blades 24, 30 across a width $w_1$, of the blade holders 23, 28, and for each splitting assembly 10, 12, extend along substantially the entire distance between the projections 36, 38, 40. Therefore, the ridges 80 occupy a total distance along the splitting line that is the majority of the width of the workpiece and, as a result, a majority of the width of the front faces of the resulting blocks. This ensures that the majority of the length of the top and bottom edges of the blocks are chipped and roughened by the ridges 80.

The ridges described herein are configured to be removable and replaceable with a different set of ridges to permit adjustment in the chipping and roughening action of the ridges. Thus, by replacing the ridges with another set of ridges having a different configuration, the resulting appearance of the blocks can be changed.

The ability to use ridges having different configurations, as well as the ability to use different projections 36, 38, 40, is important because the configuration of the ridges, as well as the size of the projections 36, 38, 40 that are used, impact the amount of chipping and roughening, and breaking, that occurs, thereby impacting the resulting appearance of the blocks. Further, the amount of chipping and roughening, and breaking, that produces the best appearance on a block generally differs based on the height of the block, with blocks of less height requiring less chipping and roughening, and breaking, and blocks of greater height requiring greater chipping and roughening, and breaking. Therefore, it is necessary to utilize appropriate configurations of the ridges and projections 36, 38, 40, based on the configuration of the resulting block, in order to produce the best appearance and to minimize cull rates (i.e. the rate of resulting blocks whose appearance is unsatisfactory as a result of the splitting operation).

As indicated in FIG. 7 (as well as in FIG. 4), the tip of the ridges 80 lie generally on a plane that is oriented at an angle $\alpha$ relative to horizontal. The angle $\alpha$ is preferably between about 5 degrees and about 20 degrees relative to horizontal. Most preferably, the angle α is about 15 degrees. As a result, the angle β of the surfaces 27*a*, 27*b*, 35*a*, 35*b* is different than the angle α, and, in the preferred embodiment, the angle β is greater than the angle α.

The angle α of the plane of the tips of the ridges affects the chipping and roughening that occurs. Further, the height A and length B of the ridges, when the ridges are viewed from the end as in FIG. 7, also affect the chipping and roughening that occurs. Moreover, the size of the projections 36, 38, 40 that are used affects the breaking action that occurs. The following table lists various dimensions for the ridges and projections that have been found to achieve satisfactory chipping and roughening, and breaking, on blocks of different heights.

| Block/Workpiece Height (inches) | Projection Diameter (inches) | β | α | Ridge Height A (inches) | Ridge Length B (inches) |
|---|---|---|---|---|---|
| 4 | 0.625 | 22 degrees | 15 degrees | 0.125 | 0.072 |
| 6 | 0.75 | 22 degrees | 15 degrees | 0.125 | 0.072 |
| 8 | 0.75 | 22 degrees | 15 degrees | 0.125–0.375 | 0.072–0.144 |
| 8 | 1.0 | 22 degrees | 20 degrees | 0.125–0.375 | 0.072–0.144 |

For each block height listed in the table above, the corresponding dimensions would be the same for both the top and bottom splitting assemblies.

Figure 3:
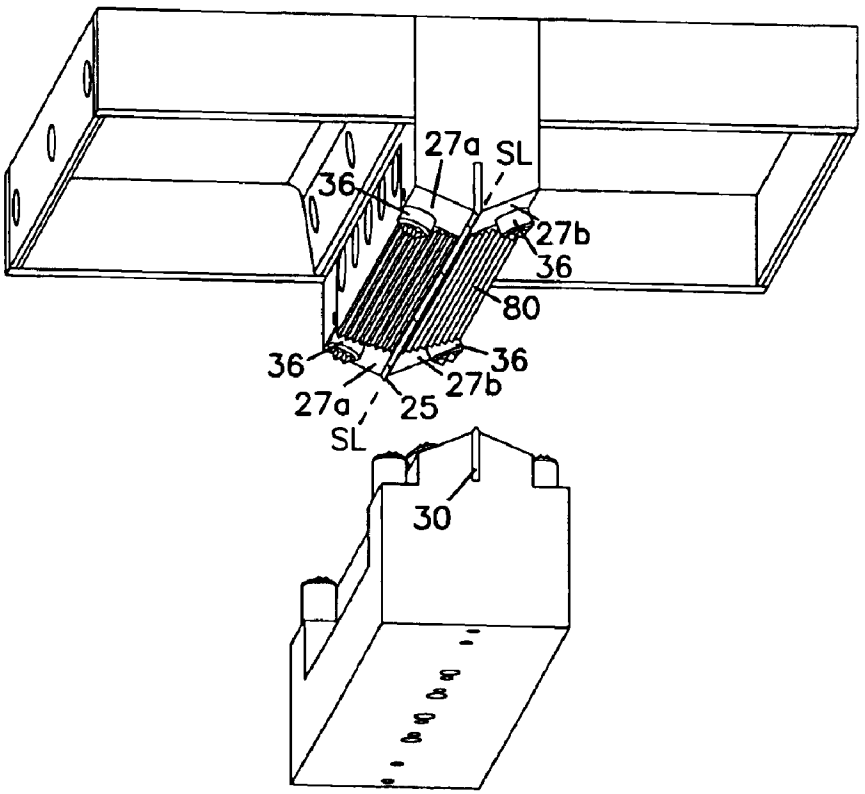
FIG. 3 is a perspective view of the top and bottom splitting assemblies looking upward toward the top splitting assembly.

In the embodiment illustrated in FIGS. 2–3 and 5–6, the ridges 80 on the bottom splitting assembly 12 are formed on plates 82 that are detachably secured to the blade holder 28 on each side of the blade 30. The plates 82 on the top splitting assembly are preferably identical in construction to the plates of the bottom splitting assembly, as illustrated in FIG. 3, although the plates 82 on the top splitting assembly 10 could have a configuration different than the plates 82 on the lower splitting assembly 10 if different chipping and roughening actions are desired.

Figure 6:
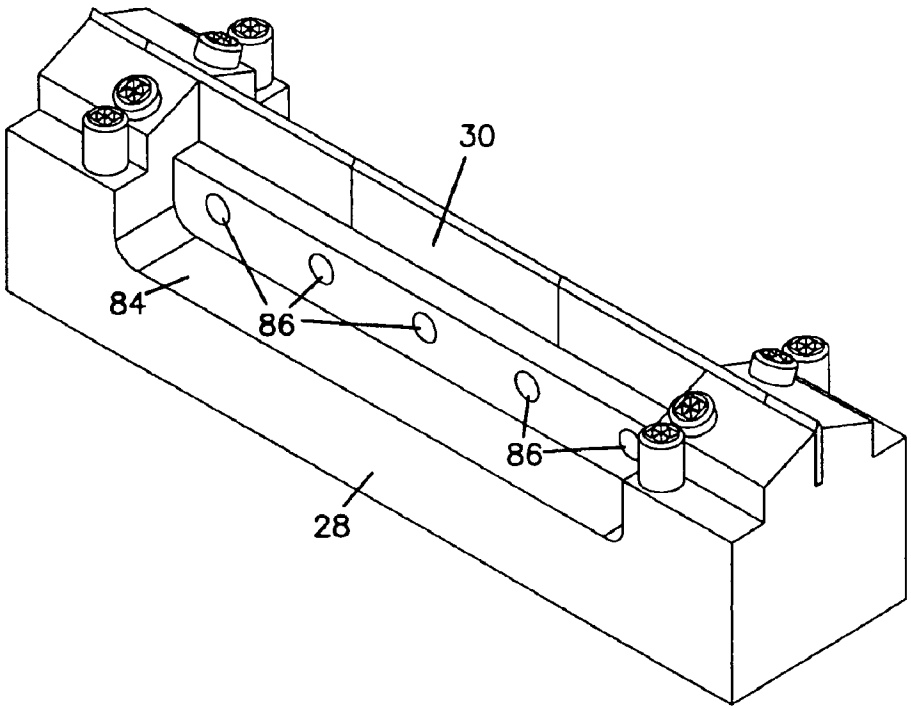
FIG. 6 is a perspective view of the bottom splitting assembly with the multiplicity of peaks removed.

The plates 82 comprise a portion 83*a* that includes the ridges 80, and a mounting flange portion 83*b*. As shown in FIG. 6 for the blade holder 28, a cut-out section 84 is formed in the blade holder 28 on each side of the blade 30 between the projections 38. The plates 82 on the blade holder 28 are fixed in place using suitable fasteners, such as bolts (not shown), that extend through apertures 85 in both of the flange portions 83*b* on each side of the blade holder 28 and through corresponding apertures 86 in the blade holder 28. For the top splitting assembly 10, if plates 82 are used, they are mounted to the blade holder 23 in a similar manner.

Figure 5:
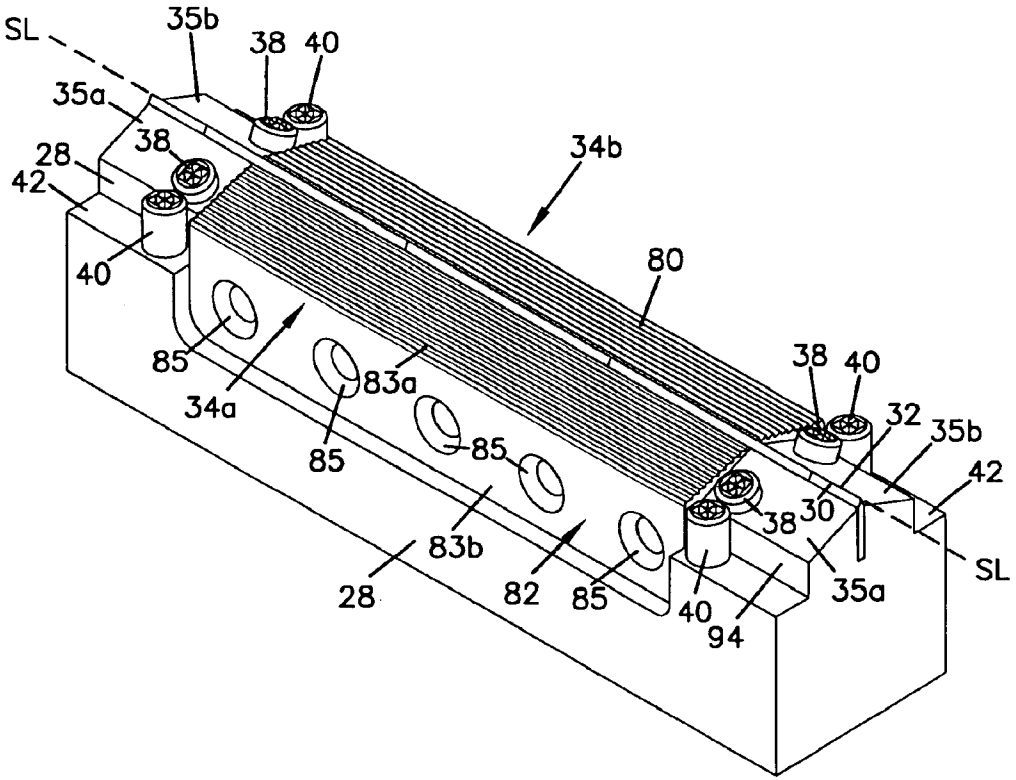
FIG. 5 is a perspective view of the bottom splitting assembly with the multiplicity of peaks in place.

The construction of the plates 82 permits an increase in the amount of ridges 80 that can be provided. As illustrated in FIG. 5, the portion 83*a* of the plate 82 is wider than the surfaces 35*a*, 35*b* containing the projections 38 so that a portion of the ridges also extend between the projections 40. In FIG. 5, the width of the portion 83*a* is the distance between the side of the blade 30 and the outer vertical surface of the flange portion 83*b*, and the width of the surfaces 35*a*, 35*b* is the distance between the side of the blade 30 and the vertical surfaces 94 of the blade holder 28. As a result, more of the upper surfaces of the resulting blocks adjacent the front faces can be chipped and roughened compared to when the ridges are provided on a surface having a width equal to the surfaces 35*a*, 35*b*.

The plates 82 can be made from A2 tool steel, although the plates could be made from other suitable materials, such as carbide, as well.

Figure 4:
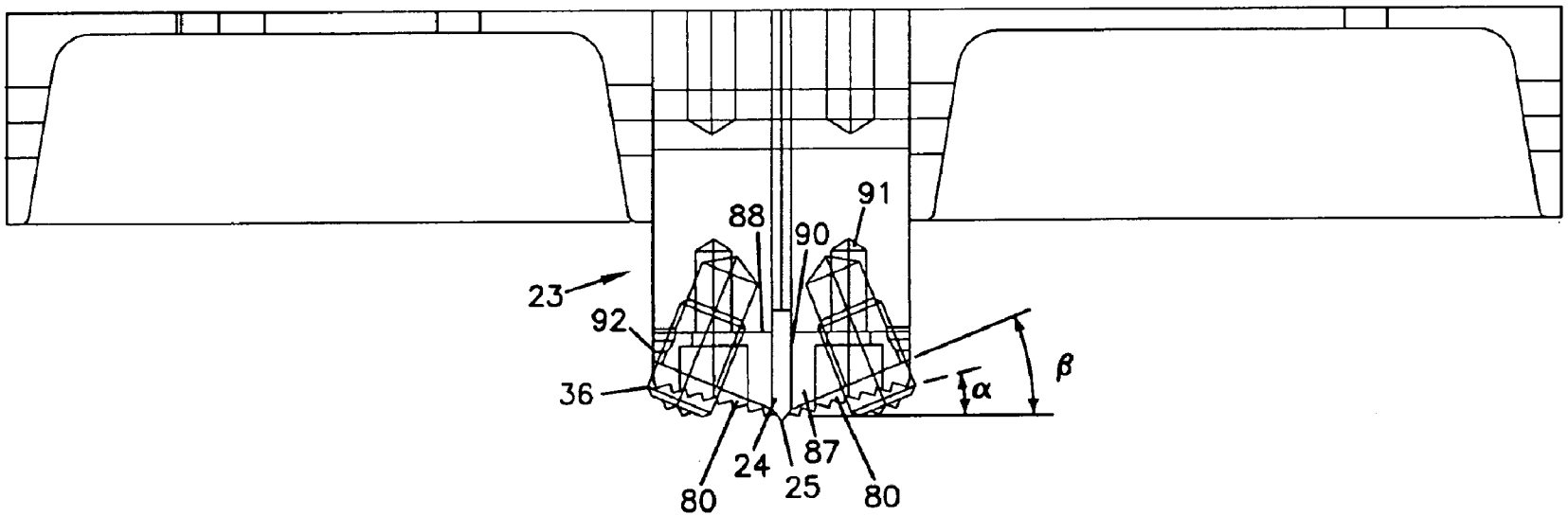
FIG. 4 is a cross-sectional view of the top splitting assembly of the invention using an alternative embodiment of a multiplicity of peaks.

An alternative form of the ridges 80 for the top splitting assembly 10 is illustrated in FIG. 4. In this embodiment, the ridges 80 are formed on bars 87 that are secured within suitably formed cut-outs on the blade holder 23. Each bar 87 includes a planar bottom side 88 that rests on a corresponding planar portion of the cut-outs of the blade holder 23, an interior planar, substantially vertical side 90 that abuts against the surface of the blade 24, an exterior planar, substantially vertical side 92, and a top side that contains the ridges 80. The bars 87 are secured to the blade holder 23 using fasteners such as screws 91.

The ridges 80 on the plates 82 and bars 87 are wear locations during the splitting process. Therefore, the detachable mounting of the plates 82 and bars 87 permits replacement of the ridges 80 as necessary. Moreover, the plates and bars can be removed and replaced with a new set of plates and bars having a different configuration of ridges 80 in order to alter the chipping and roughening action on the blocks.

Figure 9:
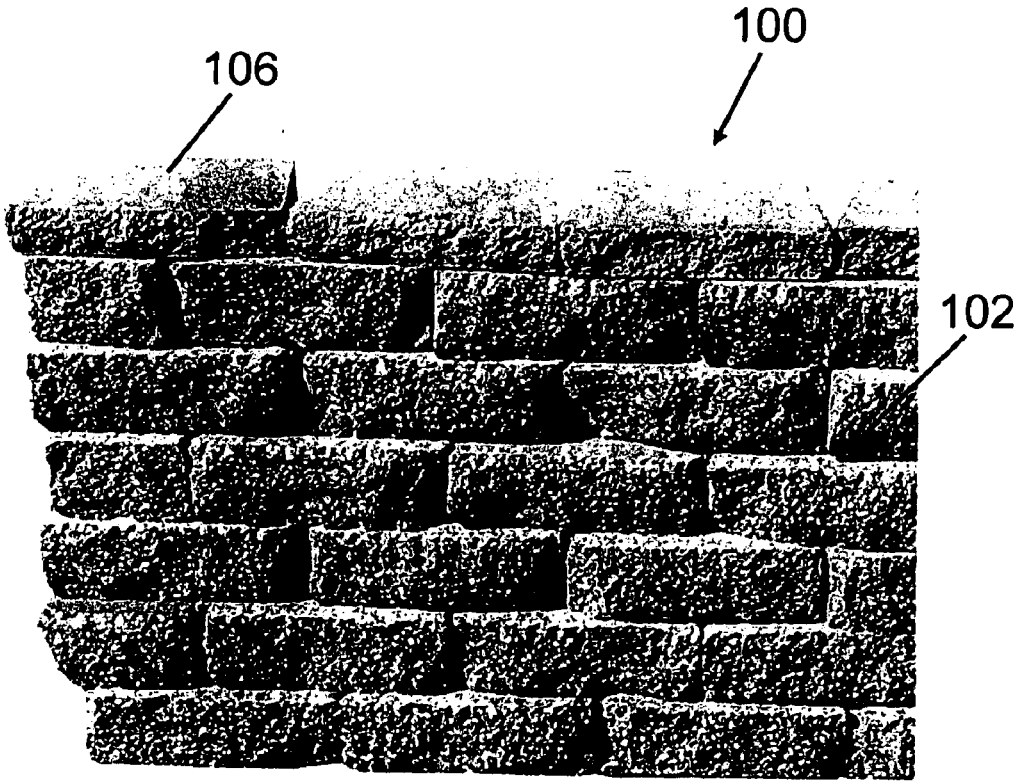
FIG. 9 is a print out of a photograph showing a portion of a wall constructed from a plurality of blocks that have been split using equipment and methods according to the present invention.

A portion of a wall 100 that is constructed from a plurality of blocks 102 resulting from splitting the workpiece 14 using the top and bottom splitting assemblies 10, 12 in FIGS. 1–6 is illustrated in FIG. 9. Each block 102 includes a block body with a generally planar top surface, a generally planar bottom surface, a pair of side surfaces, a front surface, and a rear surface.

Each block 102 also includes a locator and shear protrusion in the form of a lip or flange 104 formed integrally on the bottom surface adjacent to, and preferably forming a portion of, the rear surface. The lip 104 is best seen in FIG. 2, which illustrates a lip 104 formed at each end of the workpiece 14. The lip 104 establishes a uniform set back for the wall 100 formed from the blocks 102, and provides resistance to shear forces. In the preferred configuration, the lip 104 is continuous from one side of the block 102 to the other side.

In the blocks 102, the top and bottom surfaces do not have to be planar, but they do have to be configured so that, when laid up in courses, the block tops and bottoms in adjacent courses stay generally parallel to each other and horizontal. Further, the front surface of each block is wider than the rear surface, which is achieved by angling at least one of the side surfaces, preferably both side surfaces, so that the side surfaces get closer together (converge) as they approach the rear surface. Such a construction permits serpentine walls to be constructed. It is also contemplated that the side surfaces can start converging from a position spaced rearwardly from the front surface. This permits adjacent blocks to abut slightly behind the front face along regular surfaces that have not been altered by the action of the splitting assemblies, which in turn, means that it is less likely that fine materials behind the wall can seep out through the face of the wall.

As seen in FIG. 9, the front surface of each block has an irregular, rock-like texture. In addition, an upper edge and a lower edge of the front surface are also irregular as a result of the splitting assemblies 10, 12.

In addition, the ridges 80 of the splitting assembly 12 chip and roughen a portion of the top surface of the block adjacent the upper edge and front face of the block. Since each course of blocks is setback from the course below, a portion of the top surface of each block 102 in the lower course is visible between the front surface of each block 102 in the lower course and the front surface of each block in the adjacent upper course. In the absence of the treatment described herein, the entire top surface portion is regular and planar which creates the appearance of a ledge between each course. However, as a result of the action of the ridges 80, the chipped and roughened portions of the visible portions are irregular and non-planar, thereby minimizing the appearance of the ledge and making the wall 100 and the blocks 102 from which it is formed appear more natural. In addition, the upper edge of the block 102 is also slightly rounded as a result of the ridges 80 and grooves.

FIG. 9 also illustrates cap blocks 10 disposed on the top course of blocks 102. The cap blocks 106 present a cap course that is of a lesser height than the other courses, and cover the gaps between the blocks 102 in the top course.

Figure 8:
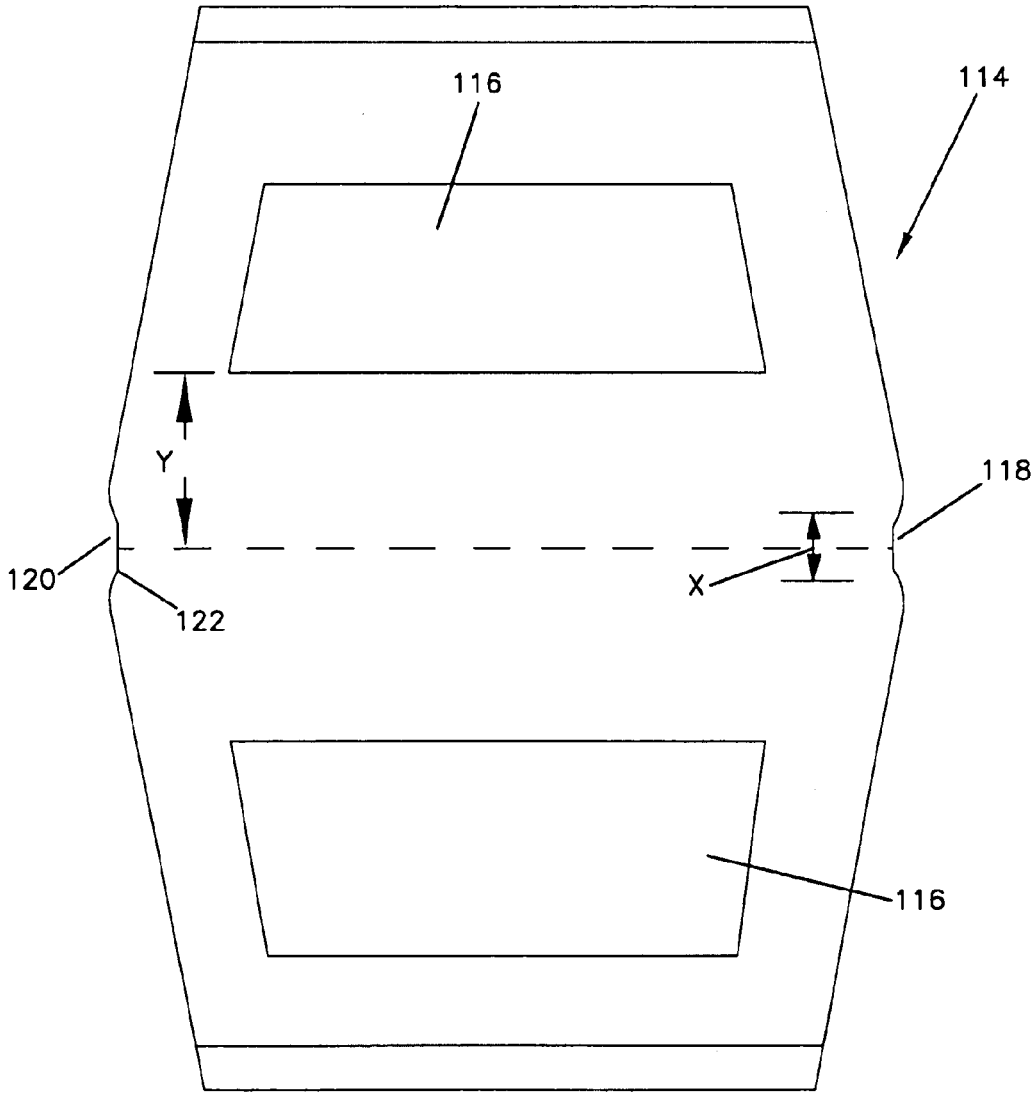
FIG. 8 is a view of a workpiece that can be split using splitting assemblies in accordance with the invention.

In FIGS. 1 and 2, the workpiece 14 is illustrated as being generally solid and without cores. However, many blocks are formed with cores in order to reduce the material used in the blocks, which reduces the weight of the blocks and reduces costs. With reference to FIG. 8, a concrete workpiece 114 that can be split to form two blocks with cores is illustrated. The workpiece 114 has a construction that is similar to the workpiece 14. However, the workpiece 114 also includes cores 116 on each side of the splitting line. For each resulting block, the cores 116 extend the entire height of the blocks from the top surface to the bottom surface.

The provision of cores 116 impacts the projections that can be used. Applicants have discovered that, when cores 116 are present, the size of the face shell, i.e. the distance Y between the core and the splitting line as illustrated in FIG. 8, impacts the size of the projections that can be used. In particular, if the distance Y is less than or equal to 2.5 inches, projections having a diameter of no greater than about 0.75 inch should be used to avoid breaking the face shell thereby resulting in an unsatisfactory block. For projections having a diameter of about 1.0 inch, the face shell distance Y should be at least about 3.0 inches.

With continued reference to FIG. 8, the workpiece 114 includes a recess 118, 120 on each side thereof adjacent the splitting line. The recesses 118, 120 are configured to help produce rounded block corners at the intersection of the front face and the side faces of the resulting blocks. At each recess 118, 120, a generally linear segment 122 is formed that crosses the splitting line. Applicants have discovered that the length X of the linear segment 122 when the resulting block is either 4.0 inches, 6.0 inches, or 8.0 inches high, is preferably about 0.2 inch.

The above specification, examples and data provide a complete description of the manufacture and use of the invention. Since many embodiments of the invention can be made without departing from the spirit and scope of the invention, the invention resides in the claims hereinafter appended.

What is claimed is:

1. A splitting assembly for a block splitting machine, comprising:

a block splitter defining a splitting line, the block splitter configured and positioned to engage a surface of a concrete workpiece and split the workpiece along the splitting line during a splitting operation to form at least one concrete block with an irregular front face; and a multiplicity of peaks that are positioned to engage a surface of the workpiece during the splitting operation and chip and roughen at least one edge of the at least one block generally along the front face of the block adjacent the splitting line, the multiplicity of peaks including peaks extending over a distance parallel to the splitting line and peaks extending over a distance away from the splitting line, the multiplicity of peaks having tips that lie generally on a plane that is at an angle that is greater than or equal to about 5 degrees and less than or equal to about 20 degrees relative to horizontal, the plane containing the tips of the peaks being further from the workpiece the further the plane is from the block splitter, and the peaks have a height that is greater than or equal to about 0.125 inch and less than or equal to about 0.375 inch.

2. The splitting assembly of claim 1, wherein the plane containing the tips of the peaks is at an angle of about 15 degrees relative to horizontal.

3. The splitting assembly of claim 1, wherein the peaks have a height of about 0.125 inch.

4. The splitting assembly of claim 1, wherein a multiplicity of the peaks are joined together to form a plurality of ridges.

5. The splitting assembly of claim 4, wherein the ridges are generally parallel to the splitting line.

6. The splitting assembly of claim 4, wherein the ridges have sharp tips.

7. The splitting assembly of claim 1, wherein the peaks have a length that is greater than or equal to about 0.072 inch and less than or equal to about 0.144 inch.

8. The splitting assembly of claim 1, wherein the peaks are configured and positioned to engage the workpiece surface so that the majority of the length of the edge of the resulting block is chipped and roughened.

9. The splitting assembly of claim 1, wherein the block splitter comprises a splitting blade.

10. The splitting assembly of claim 9, wherein the splitting blade has a straight splitting edge defining a straight splitting line.

11. A splitting assembly for a block splitting machine, comprising:

a block splitter defining a splitting line, the block splitter configured and positioned to engage a surface of a concrete workpiece and split the workpiece along the splitting line during a splitting operation to form at least one concrete block with an irregular front face;

a plurality of projections positioned to engage a surface of the workpiece at the corners of the at least one block during the splitting operation and break away portions of the workpiece at the comers of the block adjacent the splitting line; and a multiplicity of peaks between the projections and positioned to engage a surface of the workpiece during the splitting operation and chip and roughen at least one edge of the at least one block along the front face of the block adjacent the splitting line, the multiplicity of peaks including peaks extending over a distance parallel to the splitting line and peaks extending over a distance away from the splitting line, the multiplicity of peaks having tips that lie generally on a plane that is at an angle that is greater than or equal to about 5 degrees and less than or equal to about 20 degrees relative to horizontal, the plane containing the tips of the peaks being further from the workpiece the further the plane is from the block splitter, and the peaks have a height that is greater than or equal to about 0.125 inch and less than or equal to about 0.375 inch.

12. The splitting assembly of claim 11, wherein a multiplicity of the peaks are joined together to form a plurality of ridges.

13. The splitting assembly of claim 12, wherein the ridges are generally parallel to the splitting line.

14. The splitting assembly of claim 12, wherein the ridges have sharp tips.

15. The splitting assembly of claim 11, wherein the projections are generally cylindrical and have a diameter that is greater than or equal to about 0.625 inch and less than or equal to about 1.0 inch.

16. The splitting assembly of claim 15, wherein the peaks have a length that is greater than or equal to about 0.072 inch and less than or equal to about 0.144 inch.

17. The splitting assembly of claim 11, wherein the plane containing the tips of the peaks is at an angle of about 15 degrees relative to horizontal.

18. The splitting assembly of claim 11, wherein the peaks have a height of about 0.125 inch.

19. The splitting assembly of claim 16, wherein the projections have a diameter of about 0.625 inch and the plane containing the tips of the peaks is at an angle of about 15 degrees relative to horizontal.

20. The splitting assembly of claim 19, wherein the peaks have a height of about 0.125 inch and a length of about 0.072 inch.

21. The splitting assembly of claim 16, wherein the projections have a diameter of about 0.75 inch and the plane containing the tips of the peaks is at an angle of about 15 degrees relative to horizontal.

22. The splitting assembly of claim 21, wherein the peaks have a height of about 0.125 inch and a length of about 0.072 inch.

23. The splitting assembly of claim 16, wherein the projections have a diameter of about 1.0 inch and the plane containing the tips of the peaks is at an angle of about 15 degrees relative to horizontal.

24. The splitting assembly of claim 23, wherein the peaks have a height of about 0.375 inch and a length of about 0.072 inch.

25. The splitting assembly of claim 11, wherein the projections extend from a surface that is at an angle that is greater than or equal to about 15 degrees and less than or equal to about 45 degrees relative to horizontal.

26. The splitting assembly of claim 25, wherein the angle of the surface from which the projections extend is greater than or equal to about 20 degrees and less than or equal to about 25 degrees.

27. The splitting assembly of claim 26, wherein the angle of the surface from which the projections extend is about 22 degrees.

28. The splitting assembly of claim 11, wherein the projections are spaced apart from each other a distance, and the peaks are configured and positioned between the projections to engage the workpiece surface so that the majority of the length of the edge of the resulting block is chipped and roughened.

29. The splitting assembly of claim 28, wherein the peaks are configured and positioned between the projections so that substantially the entire length of the edge of the resulting block is chipped and roughened.

30. The splitting assembly of claim 11, wherein the block splitter comprises a splitting blade.

31. The splitting assembly of claim 30, wherein the splitting blade has a straight splitting edge defining a straight splitting line.

* * * * *

UNITED STATES PATENT AND TRADEMARK OFFICE

CERTIFICATE OF CORRECTION

PATENT NO. : 6,964,272 B2
APPLICATION NO. : 10/817736
DATED : November 15, 2005
INVENTOR(S) : Ronald J. Scherer It is certified that error appears in the above-identified patent and that said Letters Patent is hereby corrected as shown below:

Column 3,
Lines 49 and 51, delete “comers” and insert -- corners --;

Column 6,
Lines 29 and 30, delete “comers” and insert -- corners --;

Column 7,
Lines 40, 52 and 65, delete “comers” and insert -- corners --;

Column 8,
Line 12, delete “comers” and insert -- corners --.

Signed and Sealed this

Twentieth Day of June, 2006

JON W. DUDAS
*Director of the United States Patent and Trademark Office*